US007528689B2

(12) United States Patent
Lee et al.

(10) Patent No.: US 7,528,689 B2
(45) Date of Patent: May 5, 2009

(54) VIBRATION TYPE MEMS SWITCH AND FABRICATING METHOD THEREOF

(75) Inventors: Moon-chul Lee, Suwon-si (KR); Tae-sik Park, Suwon-si (KR); Hee-moon Jeong, Yongin-Si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 388 days.

(21) Appl. No.: 11/182,775

(22) Filed: Jul. 18, 2005

(65) Prior Publication Data

US 2006/0017125 A1 Jan. 26, 2006

(30) Foreign Application Priority Data

Jul. 20, 2004 (KR) ..... 10-2004-0056579

(51) Int. Cl.
*H01P 1/10* (2006.01)
*H01H 57/00* (2006.01)

(52) U.S. Cl. ..... 333/262; 333/105

(58) Field of Classification Search ..... 333/101, 333/103, 104, 105, 262
See application file for complete search history.

(56) References Cited

U.S. PATENT DOCUMENTS

2003/0090346 A1 5/2003 Nikitin

FOREIGN PATENT DOCUMENTS

| | | | |
|---|---|---|---|
| EP | 1146532 | A2 | 10/2001 |
| EP | 1388875 | A2 | 2/2004 |
| JP | 8-509093 | A | 9/1996 |
| JP | 11-505959 | A | 5/1999 |
| JP | 2000-090801 | A | 3/2000 |
| JP | 2002-036197 | A | 2/2002 |
| WO | 94/18688 | A1 | 8/1994 |
| WO | 96/38850 | A1 | 12/1996 |
| WO | WO 03/083886 | A | 10/2003 |
| WO | 2004/046019 | A1 | 6/2004 |

OTHER PUBLICATIONS

Nguyen, C.T.-C: "Transceiver front-end architectures using vibrating micromechanical signal processors", Topical Meeting on Silicon Monolithic Integrated Circuits in RF Systems, 2001, Dec. 12, 2001, Dec. 14, 2001, pp. 23-32, XP002377422.

*Primary Examiner*—Dean O Takaoka
(74) *Attorney, Agent, or Firm*—Sughrue Mion, PLLC

(57) ABSTRACT

A vibration type MEMS switch and a method of fabricating the vibration type MEMS switch. The vibration type MEMS switch includes a vibrating body supplied with an alternating current voltage of a predetermined frequency to vibrate in a predetermined direction; and a stationary contact point spaced apart from the vibrating body along a vibration direction of the vibrating body. When a direct current voltage with a predetermined magnitude is applied to the stationary contact point, a vibration margin of the vibrating body is increased, the vibrating body contacts the stationary contact point and the vibration type MEMS switch is turned on. A first substrate is bonded to a second substrate to isolate the vibrating body in a sealed vacuum space. The vibration type MEMS switch is turned on and/off by a resonance.

13 Claims, 5 Drawing Sheets

VIBRATION TYPE MEMS SWITCH AND FABRICATING METHOD THEREOF

CROSS-REFERENCE TO RELATED APPLICATIONS

This application claims priority from Korean Patent Application No. 2004-56579, filed Jul. 20, 2004, in the Korean Intellectual Property Office, the disclosure of which is incorporated herein in its entirety by reference.

BACKGROUND OF THE INVENTION

1. Field of the Invention

The present invention relates to a vibration type MEMS switch and a fabricating method thereof. More particularly, the present invention relates to a vibration type MEMS switch turned on and off even at a low voltage using a resonance of a vibrating body vibrating in a predetermined direction and a fabricating method thereof.

2. Description of the Related Art

With the development of the communication industry, cellular phones have been popularized. Thus, various types of cellular phones are used all over the world. Radio frequency (RF) switches are used in cellular phones to distinguish different frequency band signals. Conventionally, filter type switches are used in cellular phones. However, a leakage signal may occur between a transmitter and a receiver. Thus, there have been made attempts to use mechanical switches adopting a Micro Electro Mechanical Systems (MEMS) technique. MEMS indicates a technique for fabricating a micro unit structure using a semiconductor process technique.

In general, cellular phones use small capacity batteries so as to be portable. Therefore, a low voltage drive type switch, which is normally turned on and off using a low voltage, may be used in such a cellular phone. However, in the case of the low voltage drive type switch, a gap between a switch lever and a contact point constituting the low voltage drive type switch must be several μm or less. Thus, it is difficult to fabricate the low voltage drive type switch. In other words, the switch lever and the contact point may stick to each other in a process of fabricating the low voltage drive type switch.

During the use of the low voltage drive type switch, moisture or the like is formed in the gap so that the switch lever and the contact point stick to each other.

Also, the switch lever must be made of a material having low hardness so that the switch lever normally shifts when a low voltage is applied. In this case, when the low voltage drive type switch is turned on, the low voltage drive type switch may normally operate. However, the low voltage drive type switch may not be normally turned off due to a low restoring force caused by the low hardness. If a material having high hardness is used to solve such a problem, the low voltage drive type switch is not normally turned off even at a low voltage.

SUMMARY OF THE INVENTION

Accordingly, the present general inventive concept has been made to solve the above-mentioned problems, and an aspect of the present general inventive concept is to provide a vibration type MEMS switch including a vibrating body so as to be normally turned on and off even at a low voltage and a fabricating method thereof.

According to an aspect of the present invention, there is provided a vibration type MEMS switch including: a vibrating body supplied with an alternating current voltage of a predetermined frequency to vibrate in a predetermined direction; and a stationary contact point spaced apart from the vibrating body along a vibration direction of the vibrating body. Here, if a direct current voltage with a predetermined magnitude is applied to the stationary contact point, a vibration margin of the vibrating body may be increased, and thus the vibrating body may contact the stationary contact point.

The vibration type MEMS switch may further include: a first electrode applying the direct current voltage to the stationary contact point; and a second electrode applying the alternating current voltage to the vibrating body.

The second electrode may apply the direct current voltage having an identical frequency to a resonance frequency of the vibrating body.

The vibration type MEMS switch may further include at least one spring coupling the vibrating body and the second electrode to transmit the alternating current voltage to the vibrating body and supporting a vibration of the vibrating body.

The vibration type MEMS switch may further include: a first substrate including an upper surface including a predetermined area that is etched to form a cavity; and a second substrate including a surface including a predetermined area that is etched to form an etch area coupled to the stationary contact point. Here, the first substrate is combined with the second substrate so that the cavity and the stationary contact point are spaced apart from the vibrating body and so that the vibrating body is isolated in a sealed vacuum space.

The vibration type MEMS switch may further include a stopper stopping the vibration of the vibrating body when the vibrating body contacts the stationary contact point.

The vibration type MEMS switch may further include a drive sensor spaced apart from the vibrating body along the vibration direction of the vibrating body and sensing variations in a magnitude of an electric signal induced by the vibration of the vibrating body to detect a vibration frequency of the vibrating body.

A according to another aspect of the present invention, there is provided a vibration type MEMS switch including: a substrate; a vibrating body spaced apart from a surface of the substrate to vibrate in a direction parallel with the surface of the substrate; a stationary contact point spaced apart from the vibrating body along a vibration direction of the vibrating body; and a switching driver increasing a vibration margin of the vibrating body when a direct current voltage with a predetermined magnitude is applied, so that the vibrating body contacts the stationary contact point.

The vibration type MEMS switch may further include: an electrode applying an alternating current voltage of a predetermined frequency to the vibrating body; and at least one spring coupling the vibrating body and the electrode to transmit the alternating current voltage to the vibrating body and supporting a vibration of the vibrating body.

The vibration type MEMS switch may further include: a packaging substrate including a surface including a predetermined area that is etched to form an etch area and combined with the substrate so that the etch area is spaced apart from the vibrating body so as to isolate the vibrating body in a sealed vacuum space.

The vibration type MEMS switch may further include a stopper stopping the vibration of the vibrating body when the vibrating body contacts the stationary contact point.

The vibration type MEMS switch may further include a drive sensor spaced apart from the vibrating body along the vibration direction of the vibrating body and sensing variations in a magnitude of an electric signal induced by the vibration of the vibrating body to detect a vibration frequency of the vibrating body.

According to still another aspect of the present invention, there is provided a method of fabricating a vibration type MEMS switch, including: etching a predetermined area of a surface of a first substrate to form a stationary contact point in the etched area; stacking a conductive material on an upper surface of a second substrate in a predetermined pattern to form a vibrating body; bonding the first substrate to the second substrate so that the vibrating body is spaced apart from the stationary contact point; etching a predetermined area of a lower surface of the second substrate to secure a space in which the vibrating body is to vibrate; and bonding a third substrate to the lower surface of the second substrate to isolate the vibrating body in a sealed vacuum space.

The method may further include: etching a predetermined portion of the first substrate to form a passageway coupled to the stationary contact point; and burying a predetermined conductive material in the passageway to form an electrode electrically coupled to the stationary contact point.

BRIEF DESCRIPTION OF THE DRAWINGS

The above aspects and features of the present invention will be more apparent by describing certain exemplary embodiments of the present invention with reference to the accompanying drawings, in which.

Figure 1:
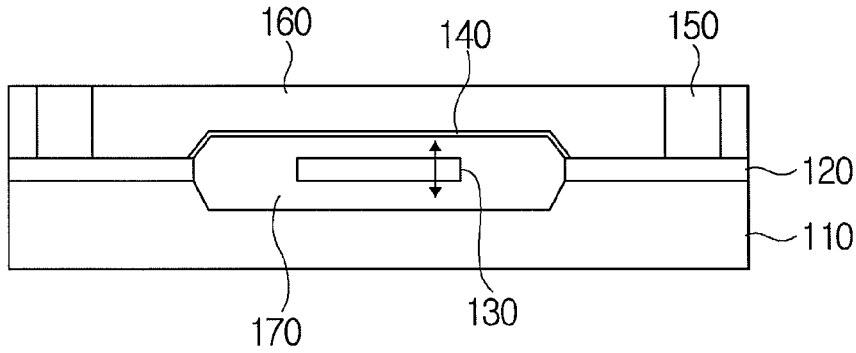
FIG. 1 is a vertical cross-sectional view of a vibration type MEMS switch according to an exemplary embodiment of the present invention.

DETAILED DESCRIPTION OF THE ILLUSTRATIVE NON-LIMITING EMBODIMENTS OF THE INVENTION

Certain exemplary embodiments of the present invention will be described in greater detail with reference to the accompanying drawings.

In the following description, same drawing reference numerals are used for the same elements even in different drawings. The matters defined in the description such as a detailed construction and elements are only provided to assist in a comprehensive understanding of the invention and are not intended to limit the scope of the invention in any way. Thus, it is apparent that the present invention can be carried out without those defined matters. Also, well-known functions or constructions are not described in detail since they would obscure the exemplary embodiments of the invention in unnecessary detail.

FIG. 1 is a vertical cross-sectional view of a vibration type MEMS switch according to an exemplary embodiment of the present invention. Referring to FIG. 1, the vibration type MEMS switch includes a first substrate 110, a conductive layer 120, a vibrating body 130, a stationary contact point 140, an electrode 150, a second substrate 160, and a cavity 170.

A predetermined area of an upper surface of the first substrate 110 is etched to form the cavity 170. The cavity 170 is formed to secure a space in which the vibrating body 130 can vibrate. The conductive layer 120 is stacked in the other area of the upper surface of the first substrate 110 except the cavity 170. A predetermined area of an upper portion of the conductive layer 120 is coupled to the stationary contact point 140, and the other area of the upper portion of the conductive layer 120 is coupled to the electrode 150. As a result, the conductive layer 120 serves to transmit an external power applied via the electrode 150 to the stationary contact point 140. The first substrate 110 may be a general glass substrate.

Since the vibrating body 130 is formed of a predetermined conductive material, the vibrating body 130 vibrates up and down due to an applied alternating current (AC) voltage. For this purpose, the vibration type MEMS switch further includes an electrode (not shown) for applying the AC voltage to the vibrating body 130 and a spring (not shown) supporting a vibration of the vibrating body 130. However, only a vertical cross-section of the vibrating body 130 is shown in FIG. 1. Thus, the electrode and the spring will be described in an exemplary embodiment that will be described later.

In this case, the vibrating body 130 is supplied with an AC voltage of a predetermined frequency and thus minutely vibrates. If a direct current (DC) voltage is applied to the electrode 150 in this state, the vibrating body 130 produces a resonance so as to increase a vibration margin. Thus, if the DC voltage is maintained for a predetermined period of time, the vibrating body 130 contacts the stationary contact point 140. As a result, the vibration type MEMS switch is turned on. In this case, since the vibration type MEMS switch uses the resonance, the vibration type MEMS switch may be driven at a low voltage of about 3V. In other words, if an AC voltage of about 1.5V is applied to the vibrating body 130, a direct current (DC) voltage of about 1.5V may be applied to the electrode 150 to turn on the vibration type MEMS switch. If the DC voltage is interrupted, the vibrating body 130 separates from the stationary contact point 140. Thus, the vibration type MEMS switch is normally turned off.

If a signal to turn on the vibration type MEMS switch is input, a magnitude of the AC voltage applied to the vibrating body 130 for a predetermined period of time may be increased to reduce a gap between the vibrating body 130 and the stationary contact point 140. If a DC voltage is applied to the vibrating body 130 in this state, the vibration margin of the vibrating body 130 is increased to contact the stationary contact point 140. In other words, the magnitude of the AC voltage can be increased to well operate the vibration type MEMS switch. Also, a speed of turning on the vibration type MEMS switch can be increased. Alternatively, the vibrating body 130 may not be supplied with the AC voltage at ordinary times but may be supplied with the AC voltage only when the vibration type MEMS switch is turned on so as to vibrate.

The frequency of the AC voltage applied to the vibrating body 130 may match with a resonance frequency of the vibrating body 130 or a frequency around the resonance frequency, so as to well operate the vibration type MEMS switch. In other words, the AC voltage of the resonance frequency is applied to the vibrating body 130 so that the vibrating body 130 vibrates with a greater vibration margin in view of its hardness.

A space in which the vibrating body 130 vibrates may be sealed in a vacuum state so that the vibrating body 130 is smoothly vibrated and restored. In other words, the first and second substrates 110 and 160 form the sealed space in which the vibrating body 130 is isolated. The stationary contact point 140 is formed along one direction of vibration directions of the vibrating body 130 so as to be spaced apart from the vibrating body 130. As shown in FIG. 1, the stationary contact point 140 is formed in an etched area of the second substrate 160. The stationary contact point 140 may be formed of a general conductive material such as aluminum (Al), tungsten (W), gold (Au), platinum (Pt), nickel (Ni), titanium (Ti), chrome (Cr), palladium (Pd), molybdenum (Mo), or the like.

Figure 2A:
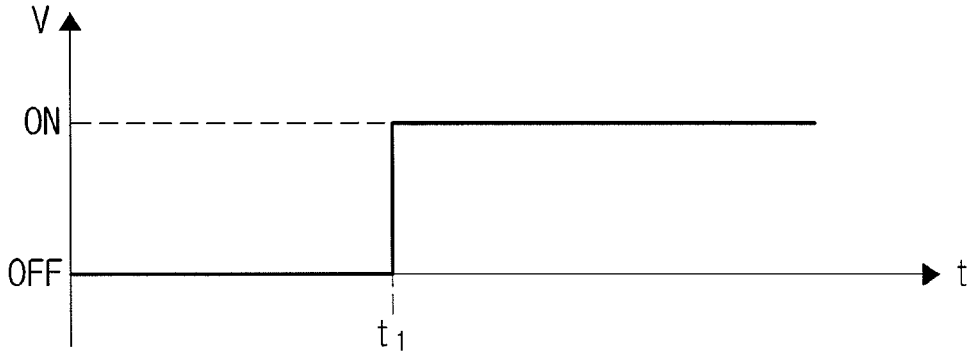
FIGS. 2A and 2B are graphs illustrating a principle of operating the vibration type MEMS switch shown in FIG. 1.
Figure 2B:
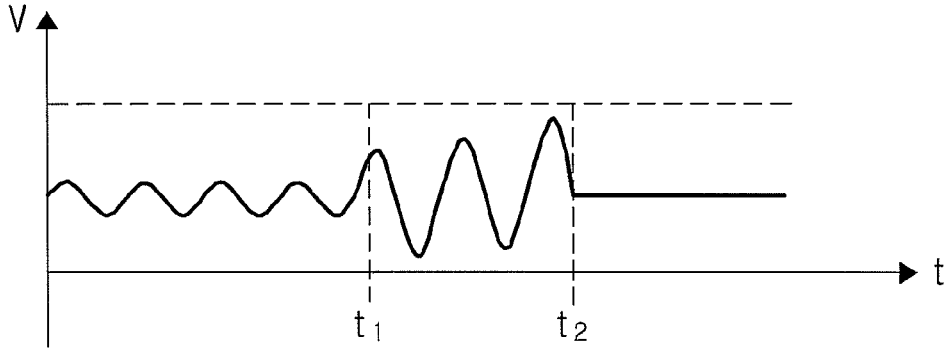

FIGS. 2A and 2B are graphs illustrating a principle of operating the vibration type MEMS switch shown in FIG. 1. FIG. 2A is a graph illustrating an input signal to turn on the vibration type MEMS switch. Referring to FIG. 2A, a signal, i.e., a DC voltage of predetermined magnitude, to turn on the vibration type MEMS switch is applied to the stationary contact point 140 at a time $t_1$.

FIG. 2 is a graph illustrating an input signal supplied to the vibrating body 130. Referring to FIG. 2B, the vibrating body 130 produces a resonance at a time $t_1$ so as to contact the stationary contact point 140 at a time $t_2$.

Figure 3:
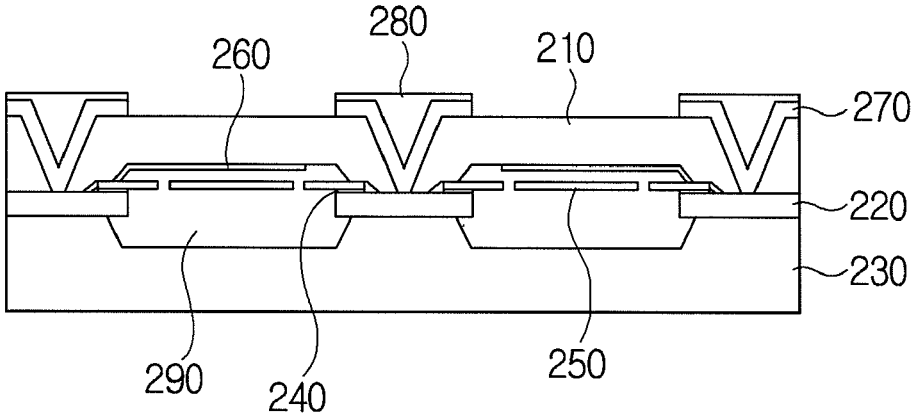
FIG. 3 is a vertical cross-sectional view of a vibration type MEMS switch according to another exemplary embodiment of the present invention.

FIG. 3 is a vertical cross-sectional view of a vibration type MEMS switch according to another exemplary embodiment of the present invention. Referring to FIG. 3, the vibration type MEMS switch includes a first substrate 210, a second substrate 220, a third substrate 230, a buffer layer 240, a vibrating body 250, a stationary contact point 260, a conductive layer 270, an electrode 280, and a cavity 290.

A predetermined area of an upper surface of the first substrate 210 is etched to be bonded to the second substrate 220 so as to isolate the vibrating body 250 in a sealed vacuum space. In other words, the vibrating body 250 is fabricated on the second substrate 220, a predetermined area of a lower portion of the second substrate 220 is etched to secure a space in which the vibrating body 250 is to vibrate, and a lower surface of the second substrate 220 is bonded to the first substrate 210.

The buffer layer 240 may be stacked on the second substrate 220 to increase an adhesive strength so as to well stack the vibrating body 250 on the second substrate 220.

The stationary contact point 260 is formed on the lower surface of the first substrate 210 to be spaced apart from the vibrating body 250 along a vibration direction of the vibrating body 250. The conductive layer 270 and the electrode 280 are formed in a passageway penetrating through the first substrate 210 to transmit a DC voltage to the stationary contact point 260. As a result, if the DC voltage is applied to the stationary contact point 260, the vibrating body 250 may contact the stationary contact point 260.

Figure 4A:
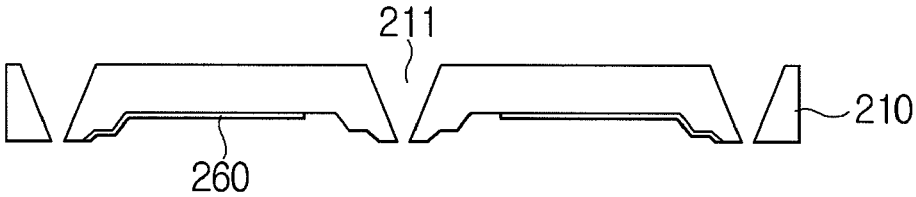
FIGS. 4A through 4F are cross-sectional views illustrating a method of fabricating the vibration type MEMS switch shown in FIG. 3.

FIGS. 4A through 4F are cross-sectional views illustrating a method of fabricating the vibration type MEMS switch shown in FIG. 3. Referring to FIG. 4A, a predetermined area of a lower surface of the first substrate 210 is etched, and a conductive material is stacked on a surface of the etched area so as to fabricate the stationary contact point 260. In this case, a predetermined area of the first substrate 210 may be etched to fabricate a passageway 211 penetrating through upper and lower portions of the first substrate 210. The passageway 211 serves to couple the stationary contact point 260 to an external power source.

Figure 4B:
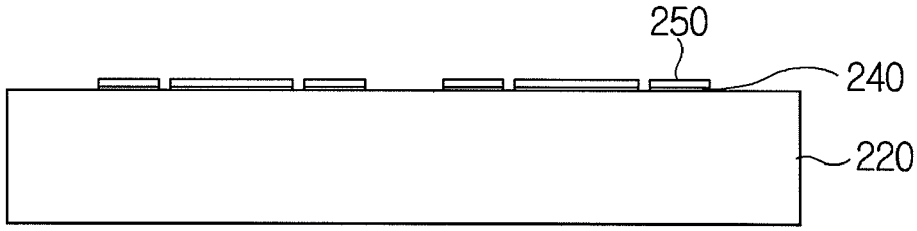

As shown in FIG. 4B, the buffer layer 240 and a conductive material are stacked on a predetermined area of an upper surface of the second substrate 220, and then the vibrating body 250 is formed in a predetermined pattern. In this case, the vibrating body 250 is formed to a thin thickness enough to vibrate even at a low AC voltage.

Figure 4C:
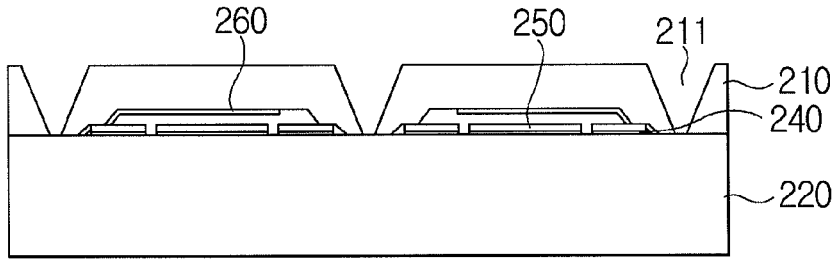

As shown in FIG. 4C, the first substrate 210 is bonded to the second substrate 220. In this case, the first substrate 210 is bonded to the second substrate 220 so that the stationary contact point 260 is spaced apart from the vibrating body 250. Also, the first substrate 210 may be bonded to the second substrate 220 using an anodic bonding method by which bonding is performed by applying a voltage.

Figure 4D:
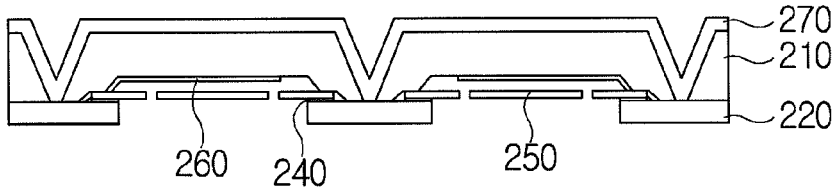

As shown in FIG. 4D, a lower portion of the second substrate 220 is etched using a lapping process and a chemical mechanical polishing (CMP) process so as to expose the vibrating body 250. Also, a conductive material is stacked in the passageway 211 formed in the first substrate 210 to form the conductive layer 270. The conductive layer 270 is electrically coupled to the stationary contact point 260.

Figure 4E:
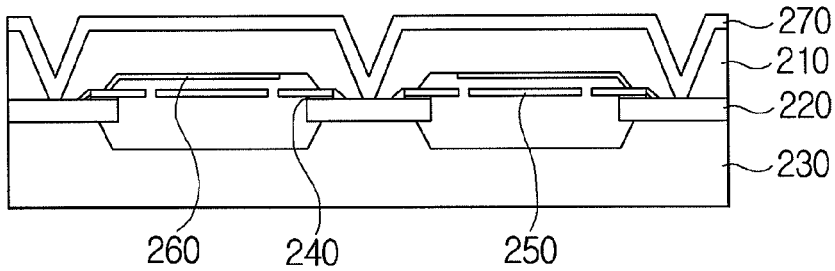

As shown in FIG. 4E, the third substrate 230 is bonded to the lower surface of the second substrate 220 to isolate the vibrating body 250 in the sealed vacuum space. In this case, a predetermined area of an upper surface of the third substrate 230 may be etched to a predetermined thickness to secure a space in which the vibrating body 250 can vibrate.

Figure 4F:
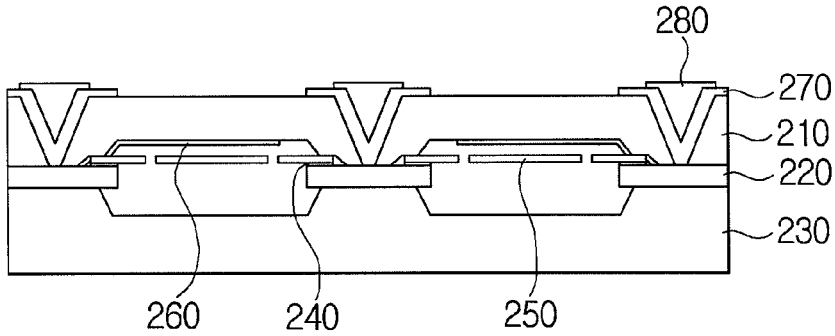

As shown in FIG. 4F, a conductive material is filled in the passageway 211 in which the conductive layer 270 is stacked to form the electrode 280. The electrode 280 serves to supply a DC voltage to the stationary contact point 260 via the conductive layer 270.

Figure 5:
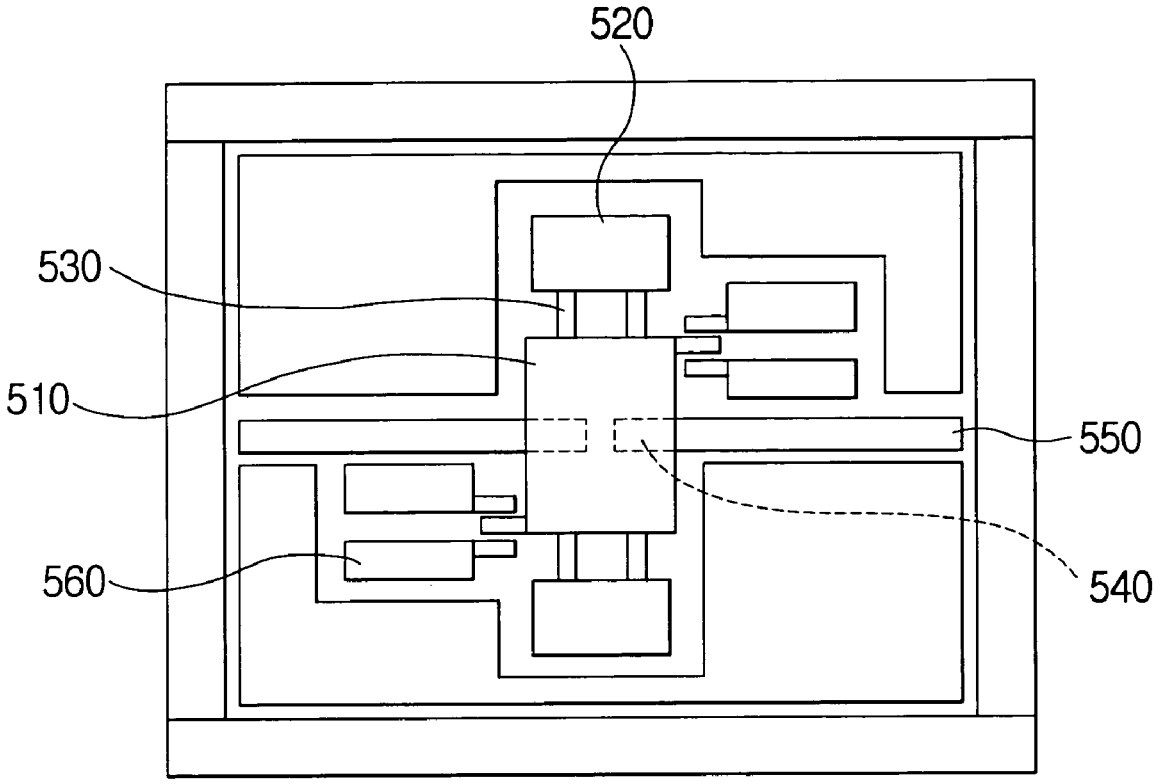
FIG. 5 is a vertical cross-sectional view of a vibration type MEMS switch according to still another exemplary embodiment of the present invention.

FIG. 5 is a vertical cross-sectional view of a vibration type MEMS switch according to still another exemplary embodiment of the present invention. Referring to FIG. 5, the vibration type MEMS switch includes a vibrating body 510, a first electrode 550, springs 530, a stationary contact point 540, a second electrode 520, and a stopper 560.

According to the present exemplary embodiment of the present invention, the vibrating body 510 vibrates up and down based on a substrate (not shown) positioned below the vibrating body 510. In this case, if a DC voltage is applied to the first electrode 550, a vibration margin of the vibrating body 510 is increased by a resonance so as to contact the stationary contact point 540. As a result, the vibration type MEMS switch is turned on.

An AC voltage is applied to the vibrating body 510 via the second electrode 520 to vibrate the vibrating body 510. The second electrode 520 is coupled to the vibrating body 510 via the springs 530. The springs 530 serve to transmit the AC voltage to the vibrating body 510 and support a vibration of the vibrating body 510. As shown in FIG. 5, four springs 530 fix the vibrating body 510 and the second electrode 520. However, the springs 530 may be fabricated in various numbers and shapes depending on the design of the vibration type MEMS switch.

The stopper 560 stops the vibration of the vibrating body 510 when the vibrating body 510 contacts the stationary contact point 540. Although the vibrating body 510 contacts the stationary contact point 540 with an increase in the vibration margin of the vibrating body 510, the vibrating body 510 may repel and thus separate from the stationary contact point 540. Thus, the stopper 560 stops the vibration of the vibrating body 510 so as to continuously turn the vibration type MEMS switch on. Although not shown in FIG. 5, a lower substrate may be coupled to an upper packaging substrate so as to isolate the vibrating body 510 in a vacuum space. According to another aspect of the present invention, the stopper 560 may not be used.

Figure 6:
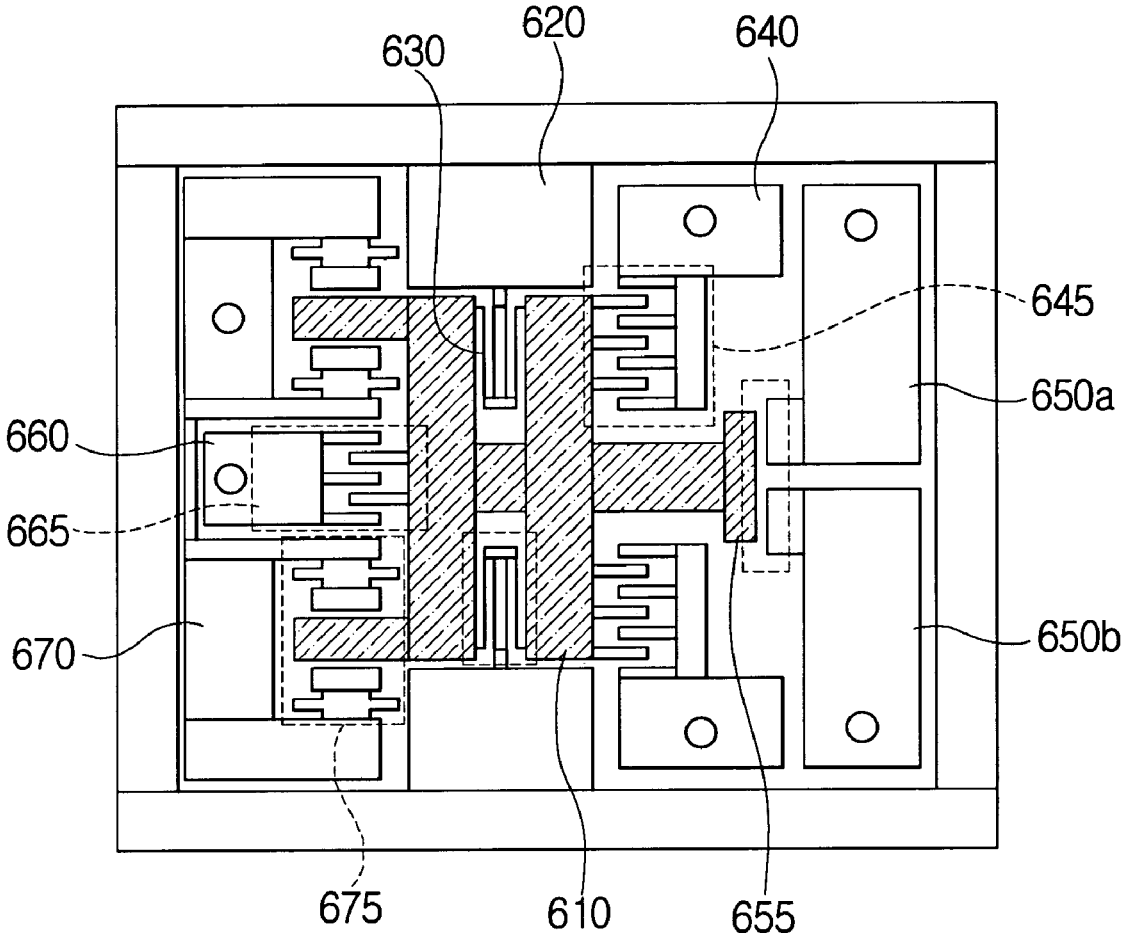
FIG. 6 is a cross-sectional view of a vibration type MEMS switch according to yet another exemplary embodiment of the present invention.

FIG. 6 is a cross-sectional view of a vibration type MEMS switch according to yet another exemplary embodiment of the present invention. Referring to FIG. 6, the vibration type MEMS switch includes a vibrating body 610, an electrode 620, a spring 630, a switching driver 640, stationary contact points 650*a* and 650*b*, a drive sensor 660, and a stopper 670. Although not shown in FIG. 6, the stationary contact points 650*a* and 650*b* may be designed and fabricated to be coupled to an external node when a DC voltage is applied but not to be coupled to the external node when an RF is applied.

According to the present exemplary embodiment, the vibrating body 610 is spaced apart from a surface of a substrate (not shown) positioned below the vibrating body 610 and supplied with an AC voltage so as to vibrate in a direction parallel with the surface of the substrate, i.e., in a horizontal direction. The AC voltage is applied via the electrode 620 and then transmitted to the vibrating body 610 via the spring 630. As described above, a frequency of the AC voltage may match with a resonance frequency.

A DC voltage is applied to the switching driver 640 so as to turn the vibration type MEMS switch on and/or off. In other words, if the DC voltage is applied to the switching driver 640, the vibrating body 610 resonates in a drive area 645. Thus, if a vibration margin of the vibrating body 610 is increased, the vibrating body 610 may contact the stationary contact points 650*a* and 650*b*. In this case, a magnitude of the AC voltage may be increased when the vibration type MEMS switch is turned on, so as to increase the vibration margin of the vibrating body 610, and then the DC voltage may be applied so that the vibrating body 610 contacts the stationary contact points 650*a* and 650*b*. The switching driver 640 may be combined with the vibrating body 610 in the drive area 645 to form a comb structure advantageous to driving of the vibration type MEMS switch.

If the vibration margin of the vibrating body 610 is increased, a contact area 655 of the vibrating body 610 directly contacts the stationary contact points 650*a* and 650*b*. Thus, the stationary contact points 650*a* and 650*b* are coupled to each other.

The drive sensor 660 is spaced apart from the vibrating body 610 along a vibration direction of the vibrating body 610. Thus, the drive sensor 660 senses variations in a magnitude of an electric signal induced by the vibration of the vibrating body 610 to detect a vibration frequency of the vibrating body 610. If the vibrating body 610 vibrates in this state, a distance between the drive sensor 660 and the vibrating body 610 varies in a drive sensing area 665 at every cycle. Thus, the drive sensor 660 senses the magnitude of the induced electric signal to detect the vibration frequency of the vibrating body 610. In this case, the induced electric signal may be an induction current, a capacitance, or the like. The sensed electric signal is fed back to an oscillator (not shown), which is coupled to the electrode 620 to apply an AC voltage, so that the oscillator adjusts the magnitude of the AC voltage so as to vibrate the vibrating body 610 at a frequency suitable for resonance.

The stopper 670 stops the vibration of the vibrating body 610 when the vibrating body 610 contacts the stationary contact points 650*a* and 650*b*, so as to prevent the vibrating body 610 from being separated from the stationary contact points 650*a* and 650*b*. More specifically, the stopper 670 contacts the vibrating body 610 in the stopping area 675 so that the stopper 670 can stop the vibration using friction with the vibrating body 610. For this purpose, an external controlling circuit (not shown) is coupled to the stopper 670 so as to control the operation of the stopper 670. As described above, the stopper 670 complements the operation of the vibration type MEMS switch and thus may not be included depending on the design of a user.

In the vibration type MEMS switch according to the present exemplary embodiment, the vibrating body 610 may be in a vacuum state so as to vibrate at a low level AC voltage and to be driven at a low level DC voltage. Thus, a lower substrate (not shown) may be coupled to an upper packaging substrate to package the vibrating body 610 so as to isolate the vibrating body 610 in a sealed vacuum space.

As described above, in a vibration type MEMS switch and a fabricating method thereof according to the exemplary embodiments of the present invention, the vibration type MEMS switch can be driven by a resonance. Thus, the vibration type MEMS switch can normally operate at a low voltage and thus can be easily used in devices such as cellular phones or the like using compact batteries. Since the vibration type MEMS switch uses the resonance, problems, such as sticking occurring in a process of fabricating a conventional low voltage drive type switch, sticking caused by moisture, or malfunctioning during turning off, can be solved. As a result, the vibration type MEMS switch can be stably turned on and/or off.

The foregoing exemplary embodiments and advantages are merely exemplary and are not to be construed as limiting the present invention. The present teaching can be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. A vibration type MEMS switch comprising:

a vibrating body supplied with an alternating current voltage of a predetermined frequency to vibrate in a predetermined direction; and a stationary contact point spaced apart from the vibrating body along a vibration direction of the vibrating body, wherein when a direct current voltage with a predetermined magnitude is applied to the stationary contact point, a vibration margin of the vibrating body is increased, and the vibrating body contacts the stationary contact point, wherein the alternating current voltage is supplied to the vibrating body at a time when the direct current voltage is applied to the stationary contact point.

2. A vibration type MEMS switch comprising:

a vibrating body supplied with an alternating current voltage of a predetermined frequency to vibrate in a predetermined direction;

a stationary contact point spaced apart from the vibrating body along a vibration direction of the vibrating body;

a first electrode applying the direct current voltage to the stationary contact point; and a second electrode applying the alternating current voltage to the vibrating body, wherein when a direct current voltage with a predetermined magnitude is applied to the stationary contact point, a vibration margin of the vibrating body is increased, and the vibrating body contacts the stationary contact point.

3. The vibration type MEMS switch of claim 2, wherein the second electrode applies the direct current voltage having an identical frequency to a resonance frequency of the vibrating body.

4. The vibration type MEMS switch of claim 2, wherein when a magnitude of the alternating current voltage applied via the second electrode is increased to increase the vibration margin of the vibrating body, the direct current voltage is applied to the stationary contact point via the first electrode so that the vibrating body contacts the stationary contact point.

5. The vibration type MEMS switch of claim 3, further comprising:

at least one spring coupling the vibrating body and the second electrode to transmit the alternating current voltage to the vibrating body, the at least one spring supporting a vibration of the vibrating body.

6. The vibration type MEMS switch of claim 1, further comprising:

a first substrate having an upper surface comprising a predetermined area that is etched to form a cavity; and a second substrate having a surface comprising a predetermined area that is etched to form an etch area, the stationary contact point being coupled to the etch area, wherein the first substrate is combined with the second substrate so that the cavity and the stationary contact point are spaced apart from the vibrating body and so that the vibrating body is isolated in a sealed vacuum space.

7. The vibration type MEMS switch of claim 6, further comprising:

a stopper stopping the vibration of the vibrating body when the vibrating body contacts the stationary contact point.

8. The vibration type MEMS switch of claim 6, further comprising:

a drive sensor spaced apart from the vibrating body along the vibration direction of the vibrating body and sensing variations in a magnitude of an electric signal induced by the vibration of the vibrating body to detect a vibration frequency of the vibrating body.

9. A vibration type MEMS switch comprising:

a substrate;

a vibrating body spaced apart from a surface of the substrate to vibrate in a direction parallel with the surface of the substrate;

a stationary contact point spaced apart from the vibrating body along a vibration direction of the vibrating body; and a switching driver increasing a vibration margin of the vibrating body when a direct current voltage with a predetermined magnitude is applied, so that the vibrating body contacts the stationary contact points, wherein an alternating current voltage is supplied to the vibrating body at a time when the direct current voltage is applied to the stationary contact point.

10. A vibration type MEMS switch comprising:

a substrate;

a vibrating body spaced apart from a surface of the substrate to vibrate in a direction parallel with the surface of the substrate;

a stationary contact point spaced apart from the vibrating body along a vibration direction of the vibrating body;

a switching driver increasing a vibration margin of the vibrating body when a direct current voltage with a predetermined magnitude is applied, so that the vibrating body contacts the stationary contact point; and an electrode applying an alternating current voltage of a predetermined frequency to the vibrating body;

at least one spring coupling the vibrating body and the electrode to transmit the alternating current voltage to the vibrating body, the at least one spring supporting a vibration of the vibrating body.

11. The vibration type MEMS switch of claim 10, further comprising:

a packaging substrate having a surface comprising a predetermined area that is etched to form an etch area and combined with the substrate so that the etch area is spaced apart from the vibrating body so as to isolate the vibrating body in a sealed vacuum space.

12. The vibration type MEMS switch of claim 11, further comprising:

a stopper stopping the vibration of the vibrating body when the vibrating body contacts the stationary contact point.

13. The vibration type MEMS switch of claim 11, further comprising:

a drive sensor spaced apart from the vibrating body along the vibration direction of the vibrating body and sensing variations in a magnitude of an electric signal induced by the vibration of the vibrating body to detect a vibration frequency of the vibrating body.

* * * * *